US006652606B1

(12) United States Patent
Zimmerman

(10) Patent No.: US 6,652,606 B1
(45) Date of Patent: Nov. 25, 2003

(54) DECORATIVE GEL WITH IN SITU-FORMED CRYSTALS EMBEDDED THEREIN, CANDLES CONTAINING THE GEL, AND A PROCESS FOR MAKING THE DECORATIVE GEL AND CANDLES

(75) Inventor: Bernard Zimmerman, Englishtown, NJ (US)

(73) Assignee: Ungerer & Company, Lincoln Park, NJ (US)

( * ) Notice: Subject to any disclaimer, the term of this patent is extended or adjusted under 35 U.S.C. 154(b) by 56 days.

(21) Appl. No.: 09/591,399

(22) Filed: Jun. 12, 2000

(51) Int. Cl.[7] ..... C10L 5/00; C11C 5/00

(52) U.S. Cl. ..... 44/268; 44/272; 44/275; 431/288; 424/126; 424/305

(58) Field of Search ..... 44/265, 268, 275, 44/272; 431/288; 424/126, 305

(56) References Cited

U.S. PATENT DOCUMENTS

| | | | | |
|---|---|---|---|---|
| 3,615,289 A | | 10/1971 | Felton | 44/275 |
| 3,645,705 A | | 2/1972 | Miller et al. | 44/275 |
| 3,771,445 A | | 11/1973 | Campbell et al. | |
| 3,819,342 A | | 6/1974 | Gunderman et al. | 44/275 |
| 3,947,232 A | | 3/1976 | Foster | |
| 3,983,677 A | | 10/1976 | Lundbom | |
| 4,225,552 A | | 9/1980 | Chang | |
| 4,369,284 A | | 1/1983 | Chen | 524/476 |
| 4,449,987 A | * | 5/1984 | Lindauer | 44/265 |
| 4,826,428 A | | 5/1989 | Lam | |
| 5,132,355 A | | 7/1992 | Nahlovsky | 524/474 |
| 5,221,534 A | | 6/1993 | DesLauriers et al. | 424/65 |
| 5,395,233 A | | 3/1995 | Karp | |
| 5,578,089 A | * | 11/1996 | Elsamaloty | 44/275 |
| D387,446 S | | 12/1997 | Bell et al. | |
| 5,843,194 A | * | 12/1998 | Spaulding | 44/275 |
| 5,871,553 A | | 2/1999 | Spaulding | 44/275 |
| 5,871,765 A | | 2/1999 | Johnson et al. | 424/595 |
| 5,879,694 A | * | 3/1999 | Morrison et al. | 424/405 |
| 5,882,363 A | | 3/1999 | Spaulding et al. | 44/275 |
| 5,927,964 A | | 7/1999 | Fawcett | |
| 5,961,967 A | | 10/1999 | Powell et al. | |
| 5,964,905 A | * | 10/1999 | Camp et al. | 44/275 |
| 6,036,925 A | | 3/2000 | Adams et al. | |
| 6,054,517 A | | 4/2000 | Spaulding et al. | 44/275 |
| 6,059,564 A | | 5/2000 | Morris | 431/291 |
| 6,066,329 A | * | 5/2000 | Morrison | 424/405 |

FOREIGN PATENT DOCUMENTS

| | | | |
|---|---|---|---|
| DE | 19925778 | * | 5/1999 |
| GB | 2347683 | * | 9/2000 |
| JP | 411288788 | | 10/1999 |
| RU | 2046131 | * | 4/1992 |
| WO | WO 98/17243 | | 4/1998 |

OTHER PUBLICATIONS

FR1417385A of DE 1542732, Jul. 2, 1970.*
CAM Resource Center, "Candle Crystals," 4pages of product and ordering information, May 31, 2000.

* cited by examiner

*Primary Examiner*—Margaret Medley
(74) *Attorney, Agent, or Firm*—Kenyon & Kenyon

(57) ABSTRACT

The present invention provides a decorative gel containing crystals that form in situ in the gel from an additive. The additive is an aromatic solid or mixture of aromatic solids and may optionally include an oil-soluble ester that aids solubilization of the aromatic compound(s) in a gel-forming material, while allowing crystallization of the aromatic compound(s) after gelation. The present invention also provides articles of manufacture like candles and sustained release air fresheners containing the gel.

33 Claims, 4 Drawing Sheets

DECORATIVE GEL WITH IN SITU-FORMED CRYSTALS EMBEDDED THEREIN, CANDLES CONTAINING THE GEL, AND A PROCESS FOR MAKING THE DECORATIVE GEL AND CANDLES

FIELD OF THE INVENTION

The present invention relates to decorative gels that lend aesthetic appeal to a wide variety of consumer products, such as candles and sustained-release air fresheners. The present invention further relates to candles, air fresheners and other items that use the decorative gels for visual effect.

BACKGROUND OF THE INVENTION

Candles have a long history as useful items. Now, in much of the world, illumination comes from flipping a switch. Candle light is used more often for an atmospheric or relaxing effect in the developed world than it is to enable people to remain active after sundown. The pleasing effect of candles is due in part to the dance of the flame, but in some cases the candles themselves are such objects of beauty that their owners never bum them.

Thirty years ago, decorative pillar candles were typically made of opaque wax dyed to a uniform color. In William Nussles' book, *Candle Crafting From an Art to a Science* (A. S. Barnes publishers), published in 1971, Chapter 6, dedicated to candle additives, mentions colorants as the only additive that is purely decorative.

Like dyed wax pillar and dipped candles, wax jar candles have been around for years. Jar candles are wax candles that are molded in a glass jar that is typically adorned with an image or etched decoration. The candle is burned in the jar and illuminates the image or decoration.

Refillable liquid candles that burn oil instead of wax became popular some twenty years ago. Unlike wax, the mineral oil used in oil candles is transparent which gives these candles a clean and contemporary appearance that was wildly successful when they were introduced. The concept and aesthetic appeal of clear oil candles was adapted to solid candles when the clear gel candle was introduced. The clear gel of a clear gel candle can be made by mixing liquid hydrocarbons, such as are suitable for use in an oil candle, with a stiffening or gelling agent. Suitable polymers for use as gelling agents are described in U.S. Pat. Nos. 5,879,694; 5,132,355; 5,843,194; 5,221,534; 3,615,289; 3,645,705; 3,819,342; and 4,449,987, and International Publication No. WO 98/17243.

Accents can be embedded in candles for decorative effect, although it was unknown at the time of the present invention to grow crystals in gel candles.

U.S. Pat. No. 5,395,233 describes a wax candle having potpourri embedded in a wax shell about a cylindrical wax candle. Alternatively, the potpourri is embedded in the middle layer of a three layer sandwich construction.

U.S. Pat. No. 6,059,564 describes a wax candle having a candle holder made of glass embedded therein for receiving a smaller candle. The smaller candle can be burned without distorting the wax that surrounds the holder.

U.S. Pat. No. 5,927,964 describes a candle that contains metal particles. The metal particles are said to improve heat transport through the wax, which results in more complete consumption of the wax as fuel. The metal particles are not dispersed evenly throughout the candle but rather reside away from the wick and the flame so as to promote more uniform burning of the candle.

It is also known to entrain gas bubbles in a gel candle as exemplified in U.S. Design Pat. No. 387,446.

Candles, sustained release air fresheners, decorative bars resembling soap and bottles with contents that can be observed from outside the bottle add a pleasing atmosphere and distinctiveness to a room. It is highly desirable to improve the visual aesthetic appeal of these items and especially desirable to do so while simultaneously imparting a pleasant delicate aroma to them which may be advantageously used in the product either alone or blended with other fragrances or may be masked easily if so desired.

SUMMARY OF THE INVENTION

The present invention provides a decorative gel and articles of manufacture containing the gel, such as candles and sustained release air fresheners. The decorative gel contains solids in a gel-matrix. The solids form after addition of an additive to a gel-forming material while in a fluid state, and gelation of the resulting composition upon cooling.

The present invention further relates to a process for making the gel of the invention by combining the gel-forming material and the additive, and gelling the resulting composition to form the decorative gel containing crystals.

The additive of the present invention comprises an aromatic compound or mixture of aromatic compounds, optionally in combination with an oil-soluble ester.

The gel of the invention can be used to impart a pleasing visual effect to many articles such as clear gel candles, sustained release air fresheners, decorative bars resembling soap and bottles whose contents may be observed from outside the bottle.

DETAILED DESCRIPTION OF PREFERRED EMBODIMENTS OF THE INVENTION

Figure 1A:
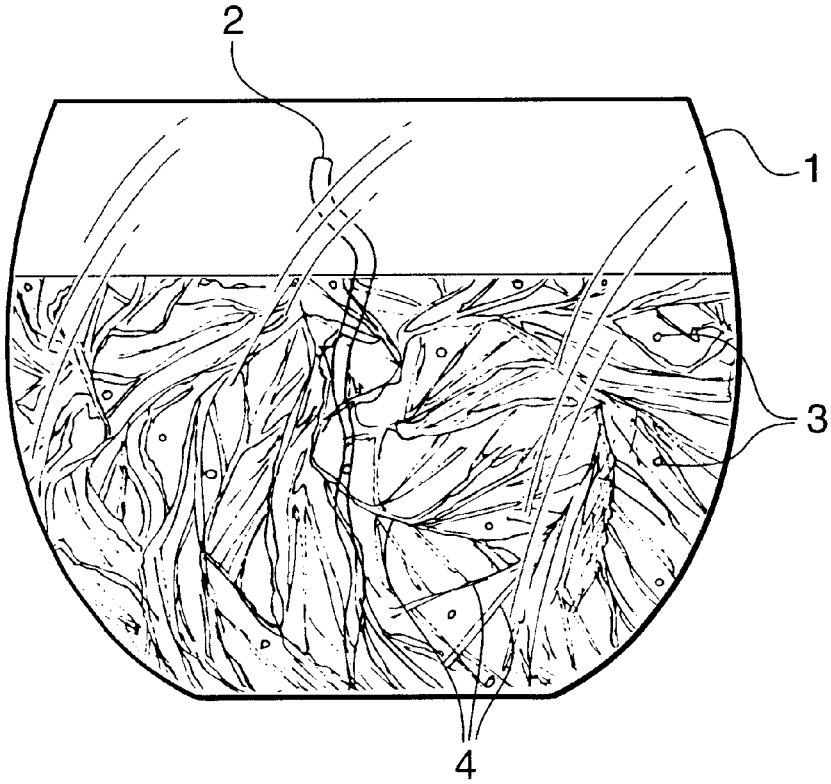
FIG. 1*a* is a top view of a decorative gel candle having filamentous crystals in a colorless gel matrix.

The present invention provides decorative gels that may be used in a variety of items to increase their aesthetic appeal. Such items include candles; sustained-release air fresheners; decorative bars resembling soap, free-standing scented items and decorative items made from transparent bottles, jelly jars and other containers whose contents are observable from outside of the container. The wide variety of aesthetically pleasing effects that may be achieved with the decorative gel of the present invention is illustrated with specific embodiments for candles and air fresheners.

The decorative gel of the present invention comprises a gel-forming material and crystals formed in the gel.

The gel-forming material of the present invention preferably is a non-aqueous gel. Preferred gel-forming materials are hydrocarbon gels made from hydrocarbon and a stiffening agent. The hydrocarbon may be any suitable fuel grade hydrocarbon. Such hydrocarbons include mineral oil, paraffinic oil, naphthelenic oil and synthetic oils like lower oligomers of propene, butene and terpene. The preferred hydrocarbon is white mineral oil, a colorless oil generally recognized as safe for contact with human skin.

The stiffening agent may include polymers, alkyl metal sulfonates, alkyl metal carboxylates and other hydrophobic substances that do not render the gel so opaque as to make the crystals invisible to an observer. Preferred stiffening agents are polymers, either homopolymers, random or alternating co- or ter-polymers, or block copolymers. Exemplary homopolymers include polypropylene, polybutene (available from Amoco Corp. under the trade name Indopol®), polyisobutene, and polyterpene (available from Hercules Corp under the trade name Piccolyte®). Exemplary diblock copolymers included styrene-isoprene, styrene-butadiene and ethylene-higher alkylene block copolymers such as the ethylene-propylene and ethylene-butylene block copolymers taught in U.S. Pat. No. 5,132,355. Exemplary A-B-A triblock copolymers include (styrene-(butylene-ethylene)-styrene) triblock copolymers such as are available from Shell Oil Co. under the trade name Kraton®. The stiffening agent may further include polyamide resins such are disclosed in U.S. Pat. Nos. 3,615,289; 3,645,705; 3,819,342 and 4,449,987, and International Publication No. WO 98/17243. The polymeric stiffening agents may be functionalized either before or after polymerization but such functionalization should not prevent crystals from forming in the gel by using a novel additive of the invention as described below.

The gel-forming material may be made conventionally by heating the hydrocarbon oil to a blending temperature, adding a desired amount of the stiffening agent while agitating the oil until the stiffening agent dissolves. Preferred weight ratios of hydrocarbon oil to stiffening agent in the gel-forming material are from about 100:1 to about 3:1 depending upon the desired hardness of the gel, and more preferably from about 32:1 to about 4:1 and most preferably about 13:1 to about 7:1. Preferred blending temperatures are from about 50° C. to about 150° C.

The preferred gel-forming material of the present invention is a white mineral oil hydrocarbon gel stiffened by an A-B-A triblock copolymer having polystyrene end segments and a polyalkylene middle segment. Such gel-forming materials are available commercially from Penreco, a division of Pennzoil, Inc., under the trade name Versagel®. The compositions of these products are described in U.S. Pat. No. 5,879,694, the disclosure of which is incorporated herein by reference in its entirety.

The crystals are caused to form in the gel matrix by combining the gel-forming material with an additive. The additive comprises an aromatic compound or combination of aromatic compounds optionally in combination with one or more oil-soluble esters. A wide variety of aromatic compounds may be used. However, at least one of the aromatic compounds in the additive should be a solid at about 20° C. when chemically pure and should be sufficiently lipophobic to be more thermodynamically stable in solid form than as a solute in the hydrocarbon oil. Suitable aromatic compounds of the invention which bear such characteristics include phenols, catechols, polyhydroxyl aromatic compounds, aromatic aldehydes, aromatic esters and aromatic lactones.

One preferred group of aromatic compounds of the present invention are catechol derivatives, such as catechol (1,2-benzenediol), vanillin, guaiacol, eugenol and the like. Particularly preferred catechol derivatives are derivatives of 3,4-dihydroxy benzaldehydes having a $C_1$–$C_4$ alkyl substituent on the 3-hydroxy group, such as vanillin, ethyl vanillin, n-propyl vanillin, i-propyl vanillin and n-, i-, s- and t-butyl vanillin. The most preferred catechol derivatives are vanillin and ethyl vanillin.

Another particularly preferred class of aromatic compounds comprises the aromatic lactone coumarin and its derivatives. Such coumarin derivatives include alkyl coumarins like 3-methyl coumarin, 4-methyl coumarin, 5-methyl coumarin, 6-methyl coumarin, 7-methyl coumarin, 8-methyl coumarin and other corresponding alkyl coumarins. Coumarin and coumarin derivatives are advantageously used in combination with other aromatic compounds of the invention.

The phenol 3,5-di-t-butyl-4-hydroxytoluene (BHT) is another preferred aromatic compound of the invention. Alternative aromatic compounds further include salicylic acid and its derivatives.

One especially preferred additive of the invention comprises a mixture of three aromatic compounds: vanillin, ethyl vanillin and coumarin. A wide variety of visual effects, i.e. platelike crystals, branched filamentous crystals and dendritic crystals, may be achieved using only one formulation of these three compounds and by adjusting the conditions under which the gel is prepared, such as the concentration of the additive, the choice of oil-soluble ester and the viscosity of the gel-forming material, as discussed in greater detail below. A formulation of about 9% vanillin (3 parts), about 71% ethyl vanillin (25 parts) and about 20% coumarin (7 parts) is especially preferred because of this versatility. Hereafter, this mixture is denominated the "3:25:7 V:EV:C mixture" to concisely express the approximate ratio of the three aromatic compounds. All percentages used in this description refer to percent by weight unless otherwise indicated.

Another especially preferred additive of the invention comprises a mixture of vanillin and ethyl vanillin in a ratio of about 1:5, hereafter denominated the 1:5 V:EV mixture.

The addition of an oil-soluble ester has been found to promote solubilization of the aromatic compounds of the invention in the gel-forming material, while allowing subsequent recrystallization of the aromatic compounds from the gel over time. The oil-soluble esters may be either aromatic or aliphatic. Esters contain a carbonyl fragment and an alkoxyl fragment. The carbonyl fragment may be either low molecular weight or high molecular weight and may be further functionalized or unfunctionalized, provided the ester is soluble in the hydrocarbon of the gel-forming material. Likewise, the alkoxyl fragment may be low or high molecular weight and either functionalized or unfunctionalized. The most preferred esters are diethyl phthalate, diisopropyl adipate, butyl lactate, benzyl benzoate, isopropyl palmitate, isopropyl myristate and Jojoba oil (a mixture of fatty acid esters).

In addition to the aromatic compound and optionally an oil-soluble ester, the additive may also contain additional fragrances, colorants and any other substances.

The process of the present invention for making the inventive decorative gel comprises the steps of combining the gel-forming material and the additive to form a composition, and then gelling the composition. The term "gelling" means hardening of the fluid composition. Gelling does not require any particular molecular arrangement. The gel may be soft like Jello® gelatin or hard as a rock.

The additive is preferably combined with the gel-forming material while the gel-forming material is fluid, i.e. its elastic memory is lost so that it conforms to the contours of a container in which it is placed and may be stirred without significant tearing. Conventionally, the gel-forming material may be warmed to an elevated blending temperature to make it fluid. The preferred blending temperature is from about 50° C. to about 150° C., more preferably about 80° C. to about 120° C.

The additive preferably is combined with the gel-forming material by contacting the additive and gel-forming material, and mechanically intermixing, blending or stirring them, preferably until the resulting composition appears uniform. The additive may be a liquid, such as one or more of the aromatic compounds of the invention dissolved in an oil-soluble ester, or a solid, such as one or more undissolved aromatic compounds. If the additive is a solid when combined with the gel-forming material, the fluidity of the gel-forming material should be maintained until the additive has completely dissolved and the resulting composition appears uniform. If an oil-soluble ester is used, then the additive is preferably a solution of the aromatic compound (s) in the oil-soluble ester. However, the oil-soluble ester may be added separately, in which case the additive of the invention may comprise the aromatic compound(s) alone or with any other additives that may be desired but are unrelated to the present invention. Likewise, when the oil-soluble ester is added separately, the oil-soluble ester may be combined with any other additives.

The composition that results from combining the gel-forming material and additive at elevated temperature preferably is cooled or is allowed to cool, which results in gelling of the composition to form the decorative gel. The decorative gel may be clear, hazy, cloudy or opaque immediately after gelation has occurred. In addition, some crystals may be visible. If so, then the crystals should be dispersed throughout the decorative gel rather than on the top or the bottom which is an indication that some crystals formed before the mixture had gelled sufficiently. Although crystals may form before the decorative gel has reached ambient temperature, often the gel is clear, hazy, cloudy or opaque and free of crystals for a period of hours or days after gelling.

The term "crystals" means a solid that forms in the gel after gelling, which interacts with light to make the solid visible within the gel matrix, or would make the solid visible but for the opacity of the gel matrix, in which case the solid will appear as irregularities on the surface of a cross section cut through a portion of the gel that contains crystals. The crystals may be visible for a variety of reasons. Examples are that the crystals are opaque solids in a clear gel matrix; or have a color which is different from the color of the gel matrix; or have a different index of refraction than the gel matrix, whether or not they are opaque or differ in color from the gel matrix; or because they reflect incident light.

The crystals may have a wide variety of appearances, as illustrated in the Figures, The crystals may appear amorphous, such as those produced in Example 4. The unique aesthetic appeal of the decorative gel of the present invention derives in part from the edge distinctness and filamentous, mica-like, feather-like, dendritic or branched appearance of the crystals. Since these visual qualities are associated with crystalline materials, the preferred crystals may be described as crystalline in appearance, although some embodiments have crystals that may be equally described as snowflake-like, tree-like or feather-like. Technically, the crystals may be amorphous or may adopt any crystalline habit, such as, platelike, needlelike, cubic and dendritic, either with or without twinning. True crystals may fall within any crystal system: cubic, hexagonal, tetragonal, trigonal, orthorhombic, monoclinic or triclinic. The terms "filamentous" and "dendritic" are used to describe some of the crystals produced in the Examples, which follow. Crystals described as dendritic have more branching than those described as filamentous, but the distinction is only relative.

Several parameters may be manipulated to change the appearance of the crystals and to slow or hasten their formation in the gel.

One of the parameters that can be adjusted to achieve a desired visual effect is the concentration of the aromatic compound. The concentration of the aromatic compound refers to the total concentration of the above-described aromatic compounds of the invention if more than one such aromatic compound is used. The concentration is based on the weight of materials combined to form the decorative gel. It is generally desirable to use an aromatic compound concentration of about 0.1% or more so that the crystals will attain a pleasing size and density in the gel matrix. An aromatic compound concentration of about 0.25% or more is preferred and about 0.5% or more is especially preferred when a high crystal density is desired. On the other hand, an aromatic compound concentration of greater than about 5% may cause the crystal density to be so high as to render the gel nearly opaque. This density can be put to use advantageously in a multilayer candle construction which uses a layer of about an inch or less of the decorative gel between a core and a transparent outer layer. However, for use in bulk items that exceed about two inches on a side a crystal density that results from using 5% or less aromatic compound is usually preferable for producing a decorative gel with substantial light transmittance.

Figure 2A:
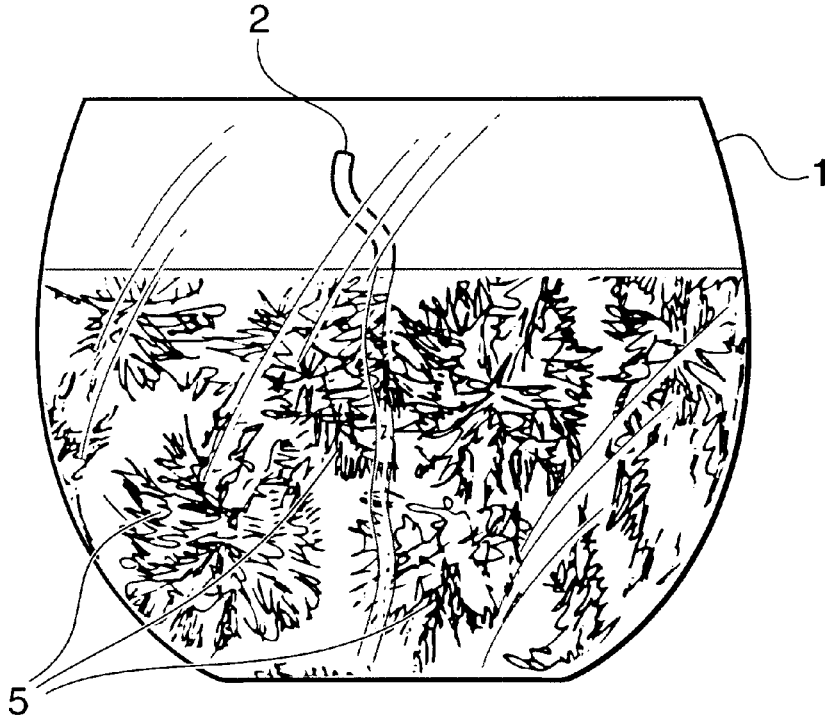
FIG. 2*a* is a top view of a decorative gel candle having dendritic crystals in a colorless gel matrix.
Figure 2B:
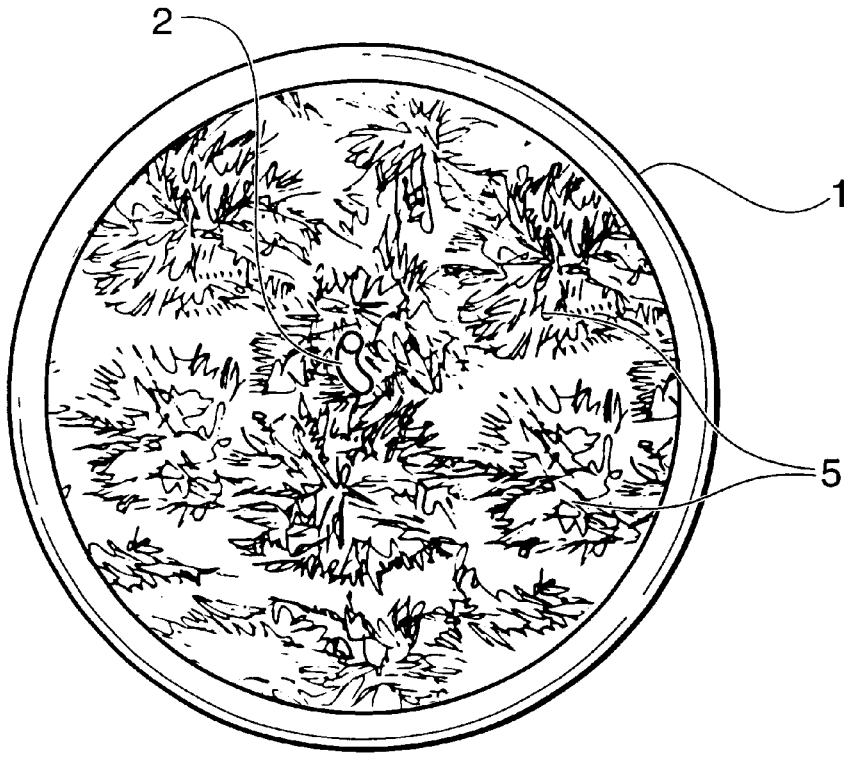
FIG. 2*b* is a perspective view of decorative gel candle having dendritic crystals in a colorless gel matrix.

For the specific purpose of obtaining a decorative gel containing platelike crystals spaced apart on average by several millimeters (as described in Example 3) using the 3:25:7 V:EV:C mixture, the total aromatic compound content is preferably between about 1 to 3%, more preferably about 2%. To obtain a high density of dendritic crystals, as shown in FIGS. 2*a* & 2*b*, a total aromatic compound content of about 0.5% to about 2%, more preferably about 1% is used. One of skill in the candlemaking art may be surprised to note that the aromatic compound concentration of the gel in FIGS. 2*a* & 2*b* is lower than that used to obtain platelike crystals spaced apart by several millimeters in Example 3.

Another of the parameters that can be adjusted to achieve a desired visual effect is the selection of oil-soluble ester that is used. For example, the decorative gels of FIGS. 1*a* & 1*b*, 2*a* & 2*b* and 3*a* & 3*b* were made using diethyl phthalate, while the decorative gel of FIGS. 4*a* & 4*b* (Example 7) was made using butyl lactate. The crystals formed in butyl lactate have a more leaf-like appearance. Amorphous looking crystals were produced using benzyl benzoate in Example 4.

Another parameter that may affect the appearance and density of crystals in the decorative gel is the ratio by weight of the oil-soluble ester to the aromatic compound or compounds ("oil-soluble ester:aromatic compound ratio"). The effect of changing the oil-soluble ester:aromatic compound ratio is dependent, within limits, upon the concentration of the aromatic compounds. Generally, the oil-soluble ester is preferably used in a ratio of about 1:4 to about 10:1 to the total weight of aromatic compound(s), more preferably about 1:1 to about 5:1, most preferably about 1.5:1. Generally, a high oil-soluble ester:aromatic compound ratio causes the crystal density in the decorative gel to be lower at a predetermined aromatic compound concentration, since the oil-soluble ester at least partially solubilizes the aromatic compounds. Thus, the crystal density may be increased for a given aromatic compound concentration by lowering the oil-soluble ester:aromatic compound ratio, i.e., by reducing the amount of oil-soluble ester in the composition. At an aromatic compound concentration of 0.5% or less, the oil-soluble ester:aromatic compound ratio is preferably about 5:1 or less.

The choice of an added fragrance, colorant or other additive may also have an effect upon the appearance of the crystals.

The rate of crystal formation tends to increase with increasing concentration of the aromatic compound(s) in the decorative gel. Generally, the total aromatic compound content of the decorative gel should be 0.5% or above so that crystals will form at a practicable rate, especially if it is desirable that crystal growth be essentially complete before the article containing the decorative gel is to be viewed for its aesthetic appeal.

The present invention contemplates both consumer items whose appearance does not change over time as well as consumer items that contain a substantially uniform gel at the time of sale and which grow crystals while the user can observe the evolution of the crystal pattern.

The crystals typically grow more slowly in more viscous gel-forming materials. For instance, the decorative gel of Example 3 containing platelike-like crystals was made using a base commonly used for air fresheners, which is less viscous than the gel-forming material used to make the decorative gel of FIGS. 1*a* & 1*b* (Example 1(A)) having a viscosity of 225 cPs at 110° C. (Versagel® M CP). The gel of Example 3 required 2 days to clarify and for observable crystal growth to be complete. The gel of FIGS. 1*a* & 1*b* required 6 days for observable crystal growth to be complete.

The following is one possible explanation for the rate of crystal formation of gels having different viscosities. However, there is no intention to limit the invention in any way to a particular theory or mechanism. A gel containing an aromatic compound concentration of 2% and above may cloud within a day after gelation. Crystal growth in such cases appears to occur by a process that involves redissolution of the minute suspended particles that cause the cloudiness. The redissolved aromatic compound(s) presumably migrate through the gel and are redeposited upon a crystal.

This postulated migration and deposition process has been frozen out in one embodiment of the invention, which is described in its particulars in Example 4. That example uses the 3:25:7 V:VE:C mixture in Versagel® C MP with benzyl benzoate for the oil-soluble ester. The result is an aesthetic appearance of some merit. The crystals have an amorphous appearance, i.e. they are not branched or elongated in any one dimension and their edges are irregular. The gel matrix is cloudy, but around each crystal there is an unclouded zone from which the crystals appear to have accreted smaller particles. The effect is interesting and very unique. The crystals are set off from the cloudy gel matrix. Interconnecting unclouded zones increase the depth through which the crystals can be observed in the gel compared to the depth at which they could be observed if the gel were homogeneously cloudy. There has been no change in appearance for many months.

In addition to the crystal-forming additive of the invention, the decorative gel may contain other additives like colorants, fluorescent substances, fragrances, air bubbles, embedded solids. antioxidants, UV light absorbers, stabilizers, insect repellants, insecticides, and any other additives which do not altogether prevent the formation of crystals in the decorative gel.

Colorants include, without limitation, dyes and inorganic pigments, the inorganic pigments further including inorganic coated mica. Dyes typically are used to tint transparent gels and for this purpose oil-soluble dyes are preferred. Dyes are preferably used at low concentration in order not to obscure the crystals. Of course, the amount of colorant to use depends upon the intensity of color desired and upon the choice of colorant. The use of dyes in certain embodiments of the present invention is illustrated in Examples 5, 6 and 7.

Any additional fragrances may be added to the decorative gel. Many of the aromatic compounds of the present invention are fragrant. Additional fragrances may be added to complement or mask their fragrance. Additional fragrances may be blended with the gel-forming material and/or the crystal forming additive of the invention at any time prior to gelling. The use of additional fragrances in certain embodiments of the present invention is illustrated in Examples 1 and 7.

Insect repellents include, without limitation, citronella, DEET, and terpineol and typically comprise about 0.1 to 20% when used in a hydrocarbon gel base.

The inventive gel may be used in a wide variety of manufactured articles. For instance the decorative gel may be used in a pillar candle. To make a pillar candle, the fluid composition comprising the gel-forming material and additive of the invention, along with any other desired additives, is poured into a mold containing one or more wicks and the composition is allowed to gel. After gelling, the resulting pillar candle is released from the mold. Alternatively, the wick may be added after pouring the fluid composition into the mold.

A jar candle may be made by pouring the composition comprising the gel-forming material, the additive of the invention and any other desired additives into ajar containing one or more wicks and allowing the composition to gel before using it as a candle.

The inventive gel may also be used to form one of the layers in a candle having a layered construction such as that described in U.S. Pat. No. 5,395,233 and others that are well known to the art. Whereas the crystalline habit is affected by the relative concentrations of the various components of the composition, and the total concentration, the visual effect created by the dendrite pattern of FIGS. 2*a* & 2*b*, such as when a cylindrical layer is viewed from the side, may be obtained with a less dense appearance by this fabrication method. However, it is unnecessary to use a layered construction to separate the crystals from the flame or prevent their aromatic constituents from being burned as the candle is used. Upon heating by the flame, the crystals melt and the aromatic compounds become more fragrant and are burned along with the gel-forming material and any other flammable additives.

A sustained release air freshener may be fabricated by pouring the composition comprising the gel-forming material, the additive of the invention and any additional desired air freshening additives and/or fragrances into a container. The container may be sealed between manufacture and use to retain the fragrance components and then be reopened to use it. A plurality of sustained release gel air fresheners or other free standing scented items may be fabricated by pouring the composition into a mold and allowing the composition to gel. After gelling, the decorative gel is released from the mold and may be sliced into segments which may be used in automotive or room air fresheners in any conventional manner.

Having thus described the present invention with reference to certain preferred embodiments, the following examples are provided to further illustrate the characteristics of the inventive gel and the process for making it and its used in candles and sustained release air fresheners. One skilled in the art will recognize variations and substitutions in the methods as described and exemplified which do not depart from the spirit and scope of the invention.

EXAMPLES

Example 1

Filamentous Crystals in a Colorless Gel

Figure 1B:
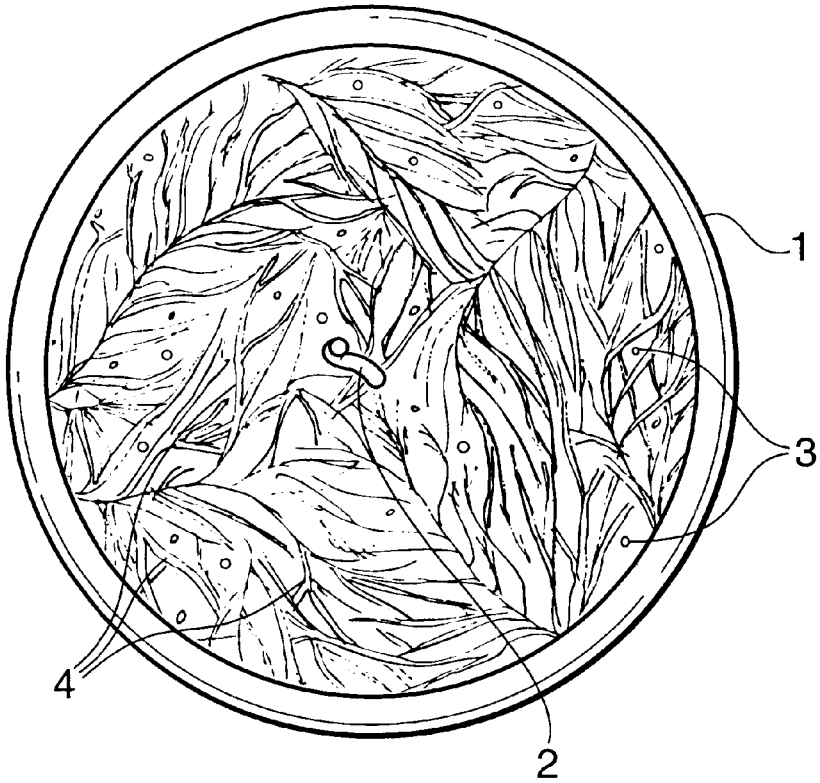
FIG. 1*b* is a perspective view of decorative gel candle having filamentous crystals in a colorless gel matrix.

A) An additive was prepared containing 3.40% vanillin, 28.34% ethyl vanillin, 7.94% coumarin, and 60.32% diethyl phthalate. The ratio of diethyl phthalate to the aromatic compounds is 1.52:1. This additive (2.0 g) was mixed with fragrance known among fragrance chemists as "Christmas Berry." Colorless hydrocarbon gel (78 g) having a viscosity of 225 cPs at 110° C. and specific gravity of 0.87 (commercially available as Penreco Versagel® C) was heated to 107° C. The additive with added fragrance was then stirred into the hydrocarbon gel. Referring to FIGS. 1*a* & 1*b*, the resulting clear homogeneous mixture was then poured into a glass container 1 containing a wick 2 and was allowed to cool to room temperature. The stirring had introduced air bubbles 3 into the gel, which were allowed to remain, providing a pleasing effect complementary to the large branched filamentous crystals 4, resembling fruit on a tree. The aromatic compound concentration was 1.0%.

The gel became cloudy within twenty four hours. Crystals first appeared nine days after the gel was prepared. Thirty five days after the preparation, large branched filamentous crystals some as long as two inches extended throughout the gel and to the sides of the container.

B) An additive was prepared containing 3.40% vanillin, 28.34% ethyl vanillin, 7.94% coumarin, and 60.32% diisopropyl adipate. This additive (1.7 g)was mixed with a fragrance known among fragrance chemists as banana flambée (0.72 g). The ratio of diisopropyl adipate to the aromatic compounds is 1.52:1. Penreco Versagel® C (77.6 g) was heated to about 100° C. and the additive (2.4 g), with fragrance was then combined with colorless hydrocarbon gel as described in Example 1(A). The aromatic compound concentration was 0.83%. The resulting composition was poured into a glass container containing a wick and was allowed to cool. The gel became cloudy within two hours.

After five days, crystals had formed and extended throughout the gel. The gel matrix had begun to clear. The crystals resemble those of FIGS. 1*a* & 1*b*, but are more featherlike.

C) An additive was prepared containing 3.0% vanillin, 28.34% ethyl vanillin, 7.94% coumarin, and 60.32% isopropyl palmitate. The ratio of diisopropyl palmitate to the aromatic compounds is 1.52:1. This additive (2.0 g) was combined with colorless hydrocarbon gel as described in Example 1(A). The resulting composition was poured into a glass container containing a wick and was allowed to cool. The aromatic compound concentration was 2%.

After five days, crystals formed. These crystals were more needlelike and had less branching that those of FIGS. 1*a* & 1*b*.

Example 2

Dendritic Crystals in a Colorless Gel

Colorless hydrocarbon gel (78 g) having a viscosity of 225 cPs at 110° C. and density of 7.0 lbs/gal. (commercially available as Penreco Versagel® C MP) was heated to 100° C. The additive of Example 1(A) (2 g) was stirred into the hydrocarbon gel resulting in a clear colorless homogenous composition with entrained bubbles as in Example 1(A). Referring to FIGS. 2*a* & 2*b*, the composition was poured into a glass container 1. A wick 2 was inserted while the composition was still hot and non-viscous. The bubbles were removed by reheating the glass container and composition to 100° C. for 5 minutes without stirring. The composition was then allowed to cool. The aromatic compound concentration was 1.0%.

This decorative gel started to become cloudy before it had completely cooled. Two days later, dendritic crystals 5 could be observed in the cloudy gel. Within six days, the crystals extended to the edges of the container, and to the exposed upper surface of the candle and completely filled the container. The gel had completely clarified. As can be seen in FIGS. 2*a*& 2*b*, the dendritic crystals 5 radiate from a point like snowflakes, but in three-dimensions.

Example 3

Platelike Crystals in Colorless Gel

Colorless hydrocarbon gel (81.7 g) having a density of 6.6 lbs/gal (commercially available as Penreco Versagel® F 1000). was heated to 94° C. The additive of Example 1(A) (4.3 g) was stirred into the hydrocarbon gel. The composition was poured into a 4 oz glass container with thread lid. The stirring entrained bubbles in the composition which were allowed to remain. The container was capped and the composition was allowed to cool. The aromatic compound concentration was 2%.

The cooled gel was opaque. One day later, glassy platelike crystals resembling large mica chips began to form in the gel, which was still cloudy. On the second day, the gel matrix was visibly less cloudy and after two days the gel matrix was clear and colorless with platelike crystals dispersed throughout the gel but spaced apart from each other with average spacings of about 1–3 millimeters from neighboring crystals, giving the gel an open and overall translucent appearance.

Example 4

Amorphous Crystals in Gel Matrix Frozen in Cloudy State with Unclouded Zones Surrounding Crystals An additive was prepared containing 3.40% vanillin, 28.34% ethyl vanillin, 7.94% coumarin, and 60.32% benzyl benzoate. The ratio benzyl benzoate to the aromatic compounds is 1.52:1. Penreco Versagel® C MP (78 g) was heated to 100° C. The additive (2 g) was stirred into the hydrocarbon gel and the resulting clear, colorless, homogenous solution was poured into a glass container containing a wick. Entrained air bubbles were removed by heating the candle in an oven at 100° C. for five minutes. The candle was then allowed to cool. The aromatic compound concentration was 1%.

After one day, the gel became cloudy. After twelve days, small amorphous looking crystals, were visible. Over a period of about two days, zones of uncloudy gel increased in size after which further clarification of the gel ceased.

Example 5

Dendritic Crystals in a Dark Blue Gel: High Crystal Density

Penreco Versagel® C MP (85.5 g) was heated to 100° C. The additive of Example 1(A) (4.5 g) was stirred into the hydrocarbon gel resulting in a clear colorless homogenous mixture with entrained bubbles as in Example 1. Blue dye A-Y0320 (Specandle DK 29550 from Spectracolor) as a 5% solution in benzyl benzoate (0.02 g) was then mixed into the hot composition. The composition was then poured into a glass container containing a wick and was allowed to cool. The aromatic compound concentration was 2%.

Four days later, dendritic crystals could be observed in the cloudy deep blue gel. After sixteen days, the crystals extended throughout the gel downward into it completely filling the container and the gel matrix was clear.

Example 6

Feather-like Filamentous Crystals in Light Blue Gel: Low Crystal Density

Figure 3A:
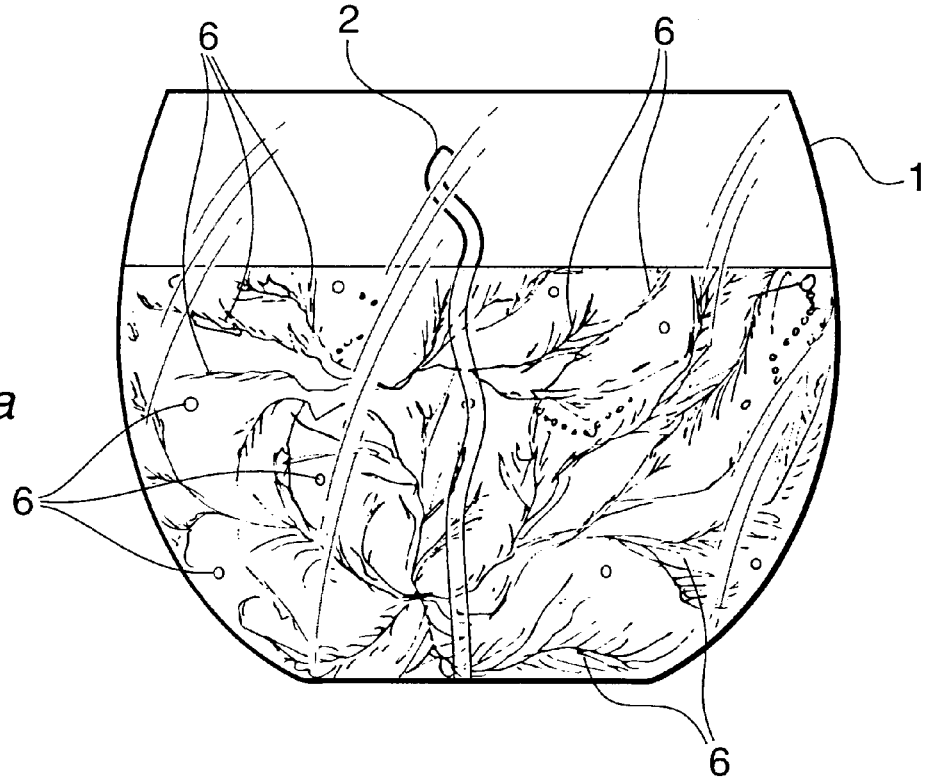
FIG. 3*a* is a top view of decorative gel candle having feather-like dendritic crystals in a gel matrix.
Figure 3B:
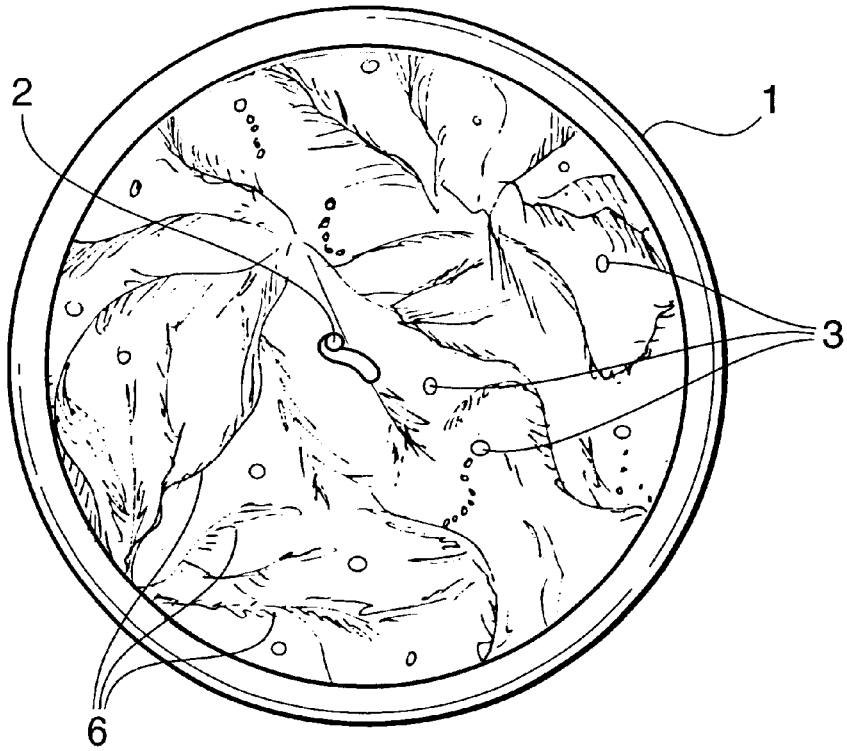
FIG. 3*b* is a perspective view of a decorative gel candle having feather-like dendritic crystals in a gel matrix.

A 0.5% solution of blue dye A-9473 (Spectracolor) in isopropyl palmitate was prepared. Penreco Versagel® C MP was heated to 100° C. One part blue dye solution was blended with 99 parts Versagel and the blue mixture was allowed to cool. The blue mixture (50 g) was blended with more Versagel® C MP (350 g) at 100° C. The additive of Example 1(A) (7.25 g) was stirred into the resulting pale blue mixture. Referring to FIGS. 3*a* & 3*b*, an 80 g. portion of the composition was poured into a small container 1 containing a wick 2 to make a small candle. The major portion was poured into a pilsner glass containing a wick to make a large candle. The composition in the candles contained entrained bubbles which were allowed to remain. The aromatic compound concentration was 0.7%. Within seven days both items contained white, feather-like, filamentous crystals 6 throughout a pale blue gel, as represented in FIGS. 3*a* & 3*b*, but without color.

Example 7

Jelly Jar Containing Filamentous Crystals in a Green Gel with Fragrance

Figure 4B:
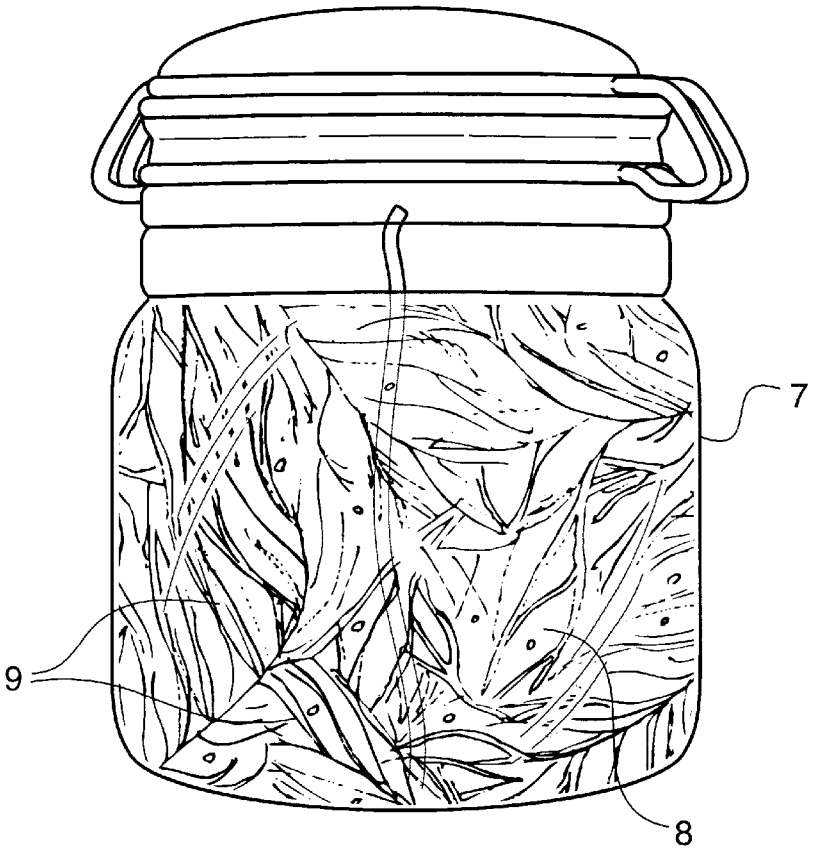
FIG. 4*b* is a perspective view of a jelly jar containing filamentous crystals in a gel with added fragrance.
Figure 4A:
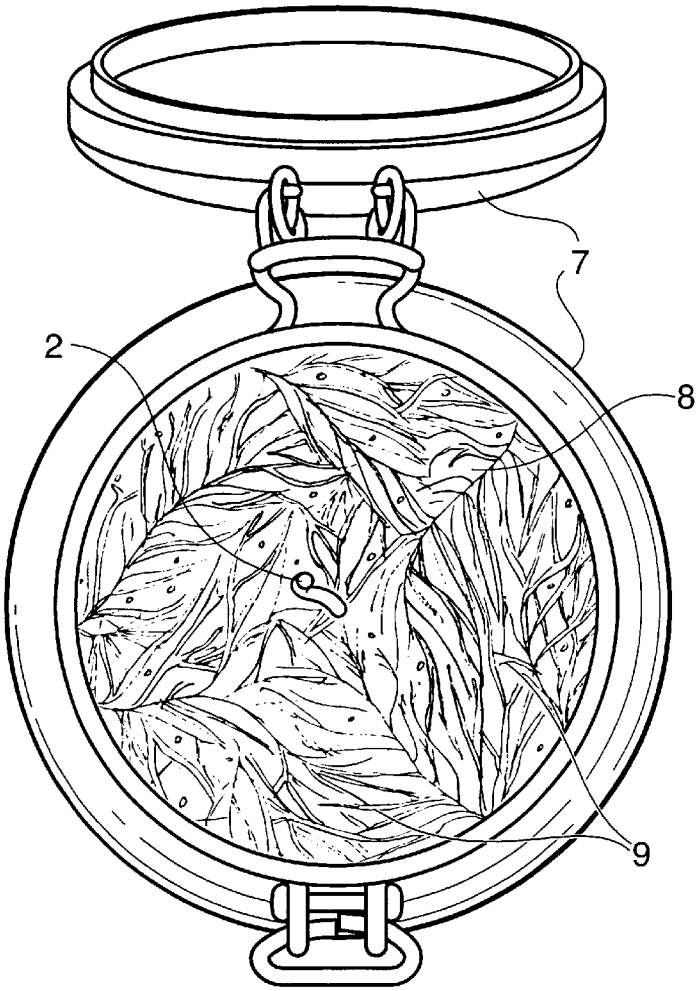
FIG. 4*a* is a top view of a jelly jar containing filamentous crystals in a gel with added fragrance.

An additive was prepared containing 3.0% vanillin, 25.0% ethyl vanillin (the 1:5 V:EV mixture) and 72.0% butyl lactate. The ratio of butyl lactate to the aromatic compounds is 2.57:1. This additive (7 g) was combined with fragrance HS-477E (3 g) known as Fir Balsam among fragrance chemists. A green dye solution was prepared by dissolving D&C yellow dye 11 and Blue dye A-9473 (Spectracolor) in a ratio of 1:1 in benzyl benzoate. Penreco Versagel® C MP (500 g) was warmed to 109° C. and the green dye solution (0.56 g) was added. The additive (25 g), with fragrance, was blended in and the resulting composition was poured into a jelly jar 7 (FIGS. 4*a* & 4*b*) containing a wick 2 and allowed to cool. The aromatic compound concentration was 0.98%. After about nine days the green gel 8 was slightly opaque and was spanned by large filamentous crystals 9 as shown in FIGS. 4*a* & 4*b*.

What is claimed is:

1. A decorative gel comprising a gel-forming material comprising a hydrocarbon oil and stiffening agent, and an aromatic compound or a mixture of aromatic compounds in a crystal-forming effective amount, and wherein said decorative gel contains visible crystals.

2. The decorative gel of claim 1 wherein at least one of the aromatic compounds is solid at 20° C. when chemically pure.

3. The decorative gel of claim 1 wherein the aromatic compound is selected from the group consisting of phenols, catechols, aromatic aldehydes, aromatic esters aromatic lactones and mixtures thereof.

4. The decorative gel of claim 3 wherein the aromatic compound is a derivative of 3,4-dihydroxy benzaldehyde having a $C_1$–$C_4$ alkyl substituent on the C3 hydroxy group or a mixture of said derivatives.

5. The decorative gel of claim 4 wherein the aromatic compound is selected from the group consisting of vanillin, ethyl vanillin and mixtures thereof.

6. The decorative gel of claim 1 wherein the aromatic compound is coumarin, a coumarin derivative or a mixture thereof.

7. The decorative gel of claim 6 wherein the aromatic compound is coumarin.

8. The decorative gel of claim 1 wherein the aromatic compound is selected from the group consisting of vanillin, ethyl vanillin, coumarin, a coumarin derivative and mixtures thereof.

9. The decorative gel of claim 1 wherein the stiffening agent is selected from the group consisting of polymers, alkyl metal sulfonates and alkyl metal carboxylates.

10. The decorative gel of claim 9 wherein the stiffening agent is a polymer.

11. The decorative gel of claim 10 wherein the polymer is an A-B-A triblock copolymer.

12. A decorative gel comprising a gel-forming material comprising a hydrocarbon oil and a stiffening agent, an aromatic compound or a mixture of aromatic compounds in a crystal-forming effective amount and an oil-soluble ester that is soluble in the hydrocarbon oil, and wherein said decorative gel contains visible crystals.

13. A process for making a decorative gel comprising the steps of a) combining a gel-forming material comprising a hydrocarbon oil and a stiffening agent, and an additive comprising an aromatic compound or a mixture of aromatic compounds in a crystal-forming effective amount to form a composition, b) gelling the composition to form a gel, and c) forming visible crystals in the gel while the gel-forming material is in a gel state.

14. The process of claim 13 wherein the aromatic compound is selected from the group consisting of phenols, catechols, aromatic aldehydes, aromatic esters, aromatic lactones and mixtures thereof.

15. The process of claim 14 wherein the aromatic compound is a derivative of 3,4-dihydroxy benzaldehyde having a $C_1$–$C_4$ alkyl substituent on the C3 hydroxy group or a mixture of said derivatives.

16. The process of claim 15 wherein the aromatic compound is selected from the group consisting of vanillin, ethyl vanillin and mixtures thereof.

17. The process of claim 13 wherein the aromatic compound is coumarin, a coumarin derivative or a mixture thereof.

18. The process of claim 17 wherein the aromatic compound is coumarin.

19. The process of claim 13 wherein the additive comprises vanillin, ethyl vanillin, coumarin, a coumarin derivative or mixtures thereof.

20. The process of claim 19 wherein the additive comprises vanillin, ethyl vanillin and coumarin in a ratio of about 3:25:7 by weight.

21. The process of claim 13 wherein the additive further comprises an oil-soluble ester that is soluble in the hydrocarbon oil.

22. The process of claim 21 wherein the oil-soluble ester is selected from the group consisting of diethyl phthalate, diisopropyl adipate, butyl lactate, benzyl benzoate, isopropyl palmitate, isopropyl myristate and Jojoba oil.

23. A decorative gel made by the process of claim 13.

24. A candle comprising a decorative gel comprising a gel-forming material comprising a hydrocarbon oil and stiffening agent, and an aromatic compound or a mixture of aromatic compounds in a crystal forming effective amount, and wherein said decorative gel contains visible crystals.

25. The candle of claim 24 wherein at least one of the aromatic compounds is solid at 20° C. when chemically pure.

26. The candle of claim 25 wherein the aromatic compound is a derivative of 3,4-dihydroxy benzaldehyde having a $C_1$–$C_4$ alkyl substituent on the C3 hydroxy group.

27. The candle of claim 25 wherein the aromatic compound comprises vanillin, ethyl vanillin, coumarin, a coumarin derivative or mixtures thereof.

28. A decorative gel candle comprising a gel-forming material comprising a hydrocarbon oil and a stiffening agent, an aromatic compound or a mixture of aromatic compounds in a crystal forming effective amount, and an oil-soluble ester that is soluble in the hydrocarbon oil, and wherein said decorative gel candle contains visible crystals.

29. A candle comprising a decorative gel made by a process comprising the steps of a) combining a gel-forming material comprising a hydrocarbon oil and a stiffening agent, and an additive comprising an aromatic compound or a mixture of aromatic compounds in a crystal-forming effective amount to form a composition b) pouring the composition into a mold or a jar containing one or more wicks, c) gelling the composition to form a gel, and d) forming visible crystals in the gel while the gel-forming material is in a gel state.

30. The candle of claim 29 wherein the aromatic compound is a derivative of 3,4-dihydroxy benzaldehyde having a $C_1$–$C_4$ alkyl substituent on the C3 hydroxy group.

31. The candle of claim 29 wherein the aromatic compound is selected from the group consisting of vanillin, ethyl vanillin, and mixtures thereof.

32. The candle of claim 29 wherein the aromatic compound comprises vanillin, ethyl vanillin, coumarin, a coumarin derivative or mixtures thereof.

33. The candle of claim 29 wherein the additive further comprises an oil-soluble ester that is soluble in the hydrocarbon oil.

* * * * *